United States Patent [19]

Thelen et al.

[11] 4,178,143

[45] Dec. 11, 1979

[54] RELATIVE ORBITING MOTION BY SYNCHRONOOUSLY ROTATING SCROLL IMPELLERS

[75] Inventors: William G. Thelen, Onondaga, Mich.; Thomas W. Bein, Annapolis, Md.

[73] Assignee: The United States of America as represented by the Secretary of the Navy, Washington, D.C.

[21] Appl. No.: 891,963

[22] Filed: Mar. 30, 1978

[51] Int. Cl.[2] ..... F01C 1/02; F01C 21/14; F04C 1/02; F04C 15/02

[52] U.S. Cl. ..... 418/19; 418/55; 418/57

[58] Field of Search ..... 418/19, 55, 57, 164, 418/201

[56] References Cited

U.S. PATENT DOCUMENTS

| | | | |
|---|---|---|---|
| 1,602,740 | 10/1926 | Bechler | 418/19 |
| 2,324,168 | 7/1943 | Montelius | 418/55 |
| 2,475,247 | 7/1949 | Mikulasek | 418/55 |
| 2,809,779 | 10/1957 | Girvin | 418/55 |
| 3,600,114 | 8/1971 | Dvorak et al. | 418/55 |

FOREIGN PATENT DOCUMENTS

| | | | |
|---|---|---|---|
| 2160582 | 6/1973 | Fed. Rep. of Germany | 418/55 |
| 2338808 | 2/1974 | Fed. Rep. of Germany | 418/55 |
| 416833 | 12/1946 | Italy | 418/164 |

*Primary Examiner*—John J. Vrablik

*Attorney, Agent, or Firm*—R. S. Sciascia; Q. E. Hodges

[57] ABSTRACT

A positive displacement pumping action is obtained from two meshed scroll vane impellers by mounting the two impellers on parallel but offset drive shafts and rotating them synchronously in the same direction.

1 Claim, 22 Drawing Figures

PRIOR ART

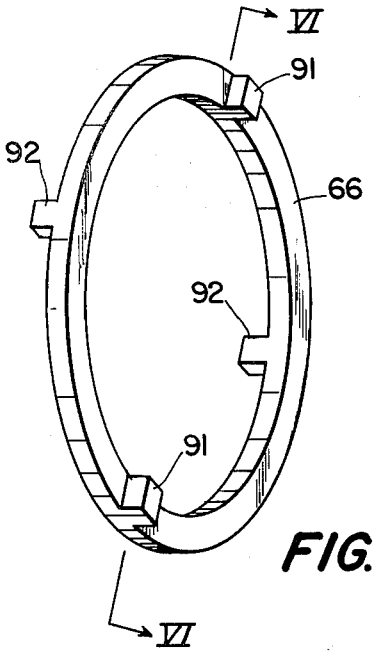
FIG. 5
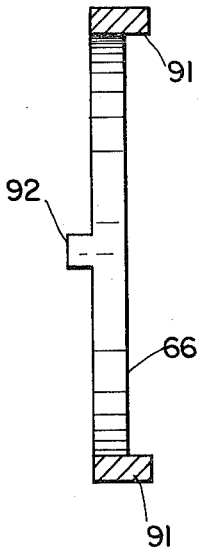
FIG. 6
FIG. 7
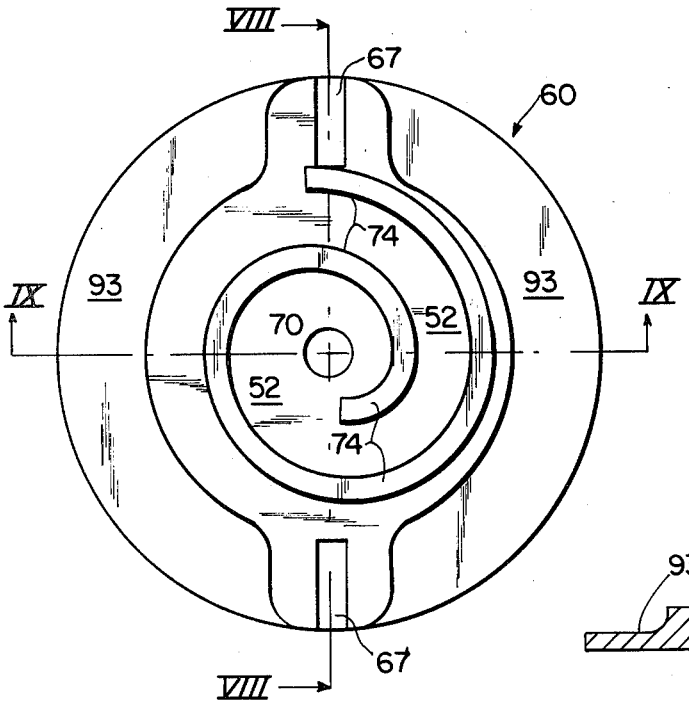
FIG. 8
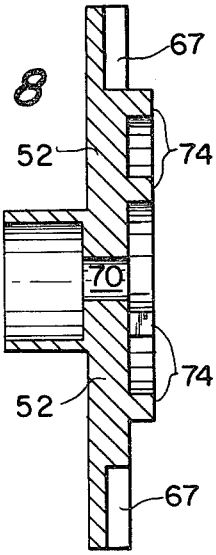
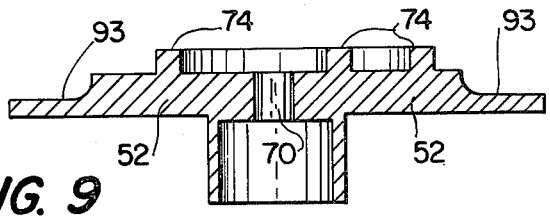
FIG. 9

RELATIVE ORBITING MOTION BY SYNCHRONOOUSLY ROTATING SCROLL IMPELLERS

The invention described herein may be manufactured and used by or for the Government of the United States of America for governmental purposes without the payment of any royalties thereon or therefor.

BACKGROUND OF THE INVENTION

This invention relates to positive displacement scroll pumps and in particular to means for moving scroll impellers to create a pumping action. The prior art discloses the use of two or more scroll vanes which are meshed with each other, as shown in FIG. 1, to create a pumping action. As shown in FIG. 2, the prior art method of creating a pumping action with two meshed scroll vanes is to hold one of the scroll vanes stationary while moving the other vane in a circular path which orbits about the center of the stationary vane. Neither the stationary scroll vane nor the orbiting scroll vane are allowed to rotate. Fluid is pumped between the center of the impellers and their outside circumference by the resulting cyclical variations in the sizes of the spaces between the scroll vanes and therefore the pumping action is a positive displacement action. In a centrifugal pump with a scroll like vanes, the pumping actions result entirely from the centrifugal force exerted on the fluid as the vanes rotate the fluid within the pump casing. Rotating the impeller in a centrifugal pump will cause the fluid pressure around the outside of the impeller to be higher than the fluid pressure near the center of the impeller regardless of which direction the impeller is rotated. In a scroll pump, the fluid pressure can be made higher at the outside of the impeller by orbiting the scroll impeller in one direction or the fluid pressure can be made higher at the center of the impeller by orbiting the scroll impeller in the opposite direction.

FIGS. 1 and 2 illustrate the operation of a prior art scroll pump. FIG. 1 shows six cross-sectional views of the scroll vanes in the pump and FIG. 2 is a highly simplified plan view of the over all pump. The scroll vane 21 is held stationary while the scroll vane 22 is moved in an orbital path. Because the vanes 21 and 22 are meshed with each other, the radius of the orbital path of vane 22 must be small enough to prevent it from rubbing against the stationary vane 21. FIGS. 1*a* through 1*e* illustrate the relative positions of the two scroll vanes while the orbiting vane 22 and its center 24 move about the stationary vane 21 and its center 23. From the starting position of the orbiting vane 22 as shown in FIG. 1*a*, the scroll orbited approximately 90 degress counter-clockwise to reach the position shown in FIG. 1*b*, it orbited approximately another 90 degrees counterclockwise to reach the position shown in FIG. 1*c* and yet another 90 degrees counterclockwise movement placed it in the position shown in FIG. 1*d*. Another 90 degree counterclockwise orbital movement placed the orbiting vane 22 in the position shown in FIG. 1*e* which is the same as its position in FIG. 1*a*. FIG. 1*f* shows the stationary vane 21 and its center 23. The dashed line and arrow 25 show the path about which the center 24 of the vane 22 orbits. Following the location and the shapes of the spaces 32, 33, 34, 35, and 38 through this same sequence of positions of the orbiting vane 22 shows how the pumping action of the two vanes occurs. As the vane 22 orbits, the space 38 at the center breaks up into the two spaces 32 and 33 which move outward and counterclockwise. After one complete orbit of the vane 22, the spaces 32 and 33 as shown in FIG. 1*e* are equivalent to the spaces 35 and 34, respectively, as shown in FIG. 1*a*. During one complete counterclockwise orbit of the vane 22, the fluid in spaces 34 and 35 will be expelled from the outside circumference of the two meshed vanes. In this manner, any fluid which is introduced through a port in the center of the scrolls will be moved about the center of the scrolls about one time and expelled at the outside circumference. Following the movements of the same spaces between the vanes through the same sequence of the five figures but in reverse order will show that if the orbiting vane 22 is orbited in a clockwise direction, the spaces between the vanes will tend to also move in a clockwise direction in from the outside of the vanes toward the center. Therefore, fluid may be pumped from the outside circumference of the scroll vanes toward their center by reversing their direction in which the scroll vane 22 orbits.

The prior art method of producing the orbiting motion of the scroll vane is illustrated in FIG. 2. The orbiting vane 22 is mounted by way of bearing 26 on the offset end of the drive shaft 31. The drive shaft 31 is supported by bearings 27 and 28 while it rotates about its axis 36. Having the scroll vane 22 thus mounted on the offset end of the rotating drive shaft 31 causes the center of the scroll vane 22 to orbit about the center of scroll vane 21. Other means, which are not illustrated in FIG. 2, are used to prevent the vane 22 from rotating as a result of torque applied to it by the shaft 31. The distance between the axis 37 of the offset portion of the shaft 31 and the axis 36 of the main portion of the shaft is referred to as the orbiting radius of the pump and is equal to the radius of the circle 25 shown in FIG. 1*f*.

Because the orbiting scroll vane 22 is attached to the offset portion of the rotating drive shaft 31, it places an unbalanced load on the drive shaft and on the bearings 26, 27, and 28. This unbalanced load on the bearings will cause them to wear out much faster than normal. Properly positioned counterweights near the offset end of the drive shaft could be used to balance the load on bearings 27 and 28 and to reduce the amount of vibration which is transmitted through those bearings to the pump casing. However, the counterweights would not reduce the amount of wear on bearing 26 or the amount of stress placed on the offset portion of drive shaft 31 by the orbiting vane. Therefore the offset portion of the drive shaft 31 and the bearing 26 must be made heavier than would otherwise be required and the bearing 26 must be replaced more often than would otherwise be necessary. The pumping capacity of a scroll pump may be reduced by reducing its orbiting radius below the maximum radius allowed by the scroll vanes, which are used. Changing the orbiting radius of a prior art scroll pump requires that a new drive shaft be installed on which the end attached to the orbiting scroll vane is offset by a different amount. Therefore, the pumping capacity of prior art scroll pumps cannot be changed while the pumps are in operation. In some applications, it would be desirable to be able to change the pump capacity while the pump is being driven at a constant RPM. Such a capability in a scroll pump would enable the pump to be switched to an idling mode of operation which would consume much less power from a constant RPM power source whenever less than the maximum pumping capacity is required.

OBJECTS OF THE INVENTION

It is an object of this invention to eliminate the unbalanced loads that are experienced on the drive shafts and bearings of prior art scroll pumps.

It is another object of this invention to eliminate the vibrations produced in prior art scroll pumps by the orbiting scroll vane.

It is a further object of this invention to facilitate varying the pumping capacity of a scroll pump while it is in operation.

It is a further object of this invention to create a positive displacement pumping action by two scroll impellers by rotating the impellers on stationary axes.

SUMMARY OF THE INVENTION

This invention uses two prior art scroll impellers to produce a pumping action similar to that in the prior art scroll pumps by mounting each of the scroll impellers on parallel but offset shafts and rotating them synchronously. One method of synchronizing the rotation of the two scroll impellers is to drive one impeller directly with the input drive shaft and to couple the second impeller to the first impeller. Another method of synchronizing the two impellers is to couple the input drive shaft directly to each of them. The distance between the two parallel but offset drive shafts of this invention is equivalent to the orbiting radius in the prior art scroll pumps. The pumping capacity of pumps built in accordance with this invention may be varied while the pumps are in operation by varying the distance between the two offset drive shafts driving the two impellers.

BRIEF DESCRIPTION OF THE DRAWINGS

FIG. 5 shows a pictorial view of the oldham ring which is used in the preferred embodiment of this invention;

FIG. 6 shows a cross-sectional view of the oldham ring shown in FIG. 5;

FIG. 7 is a plan view of the driven impeller 52 shown in the preferred embodiment of the invention in FIG. 4;

FIG. 8 is a cross-sectional view of the driven impeller shown in FIG. 7;

FIG. 9 is another cross-sectional view of the driven impeller shown in FIG. 7;

DESCRIPTION OF THE PREFERRED EMBODIMENT

Figure 1A:
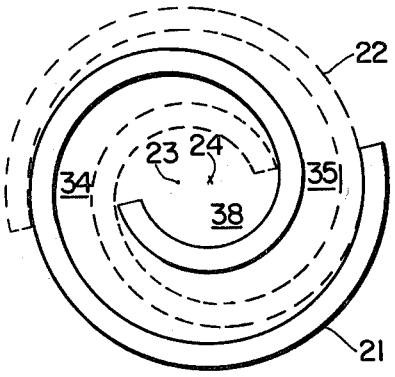
FIGS. 1*a*–1*f* shows six simplified cross-section views of two meshed scroll vanes which illustrate the pumping action of a prior art scroll pump.
Figure 1B:
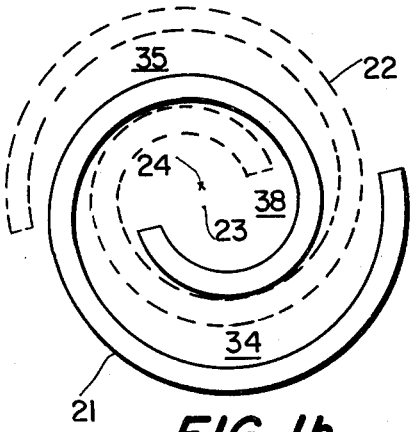
Figure 1C:
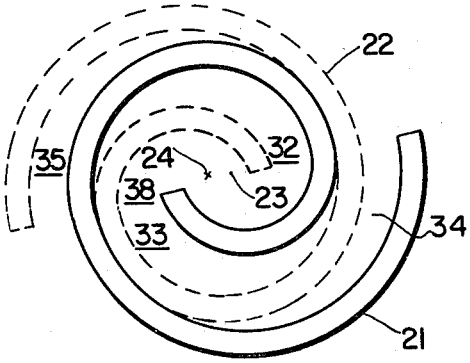
Figure 1D:
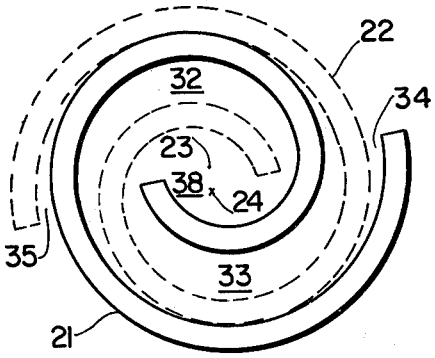
Figure 1E:
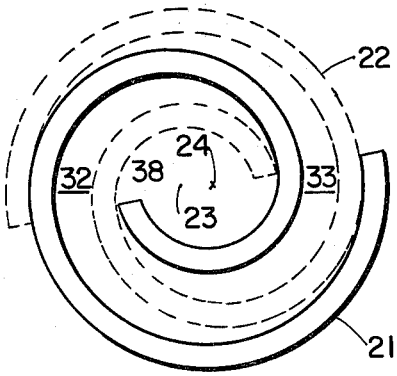
Figure 1F:
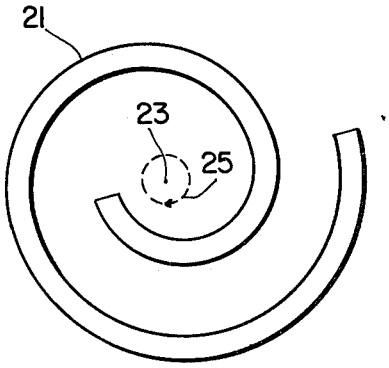
Figure 3A:
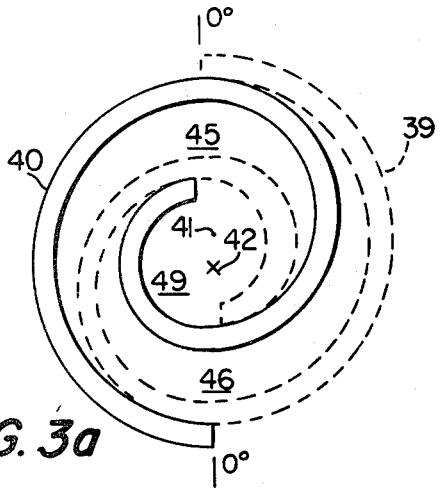
FIGS. 3*a*–3*e* shows five simplified cross-sectional views of two meshed scroll vanes to illustrate the pumping action of scroll pumps built in accordance with this invention.
Figure 3B:
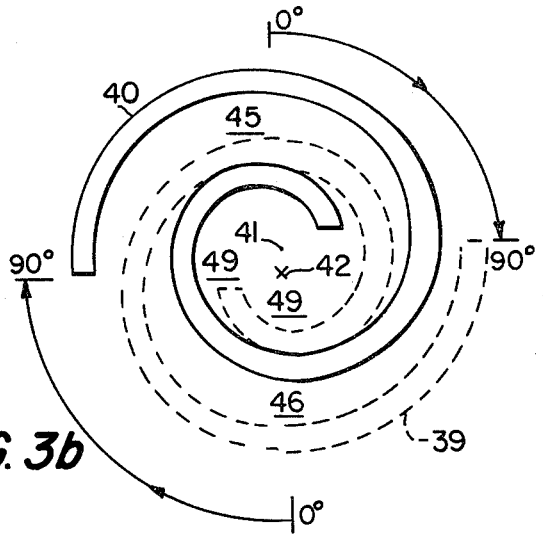
Figure 3C:
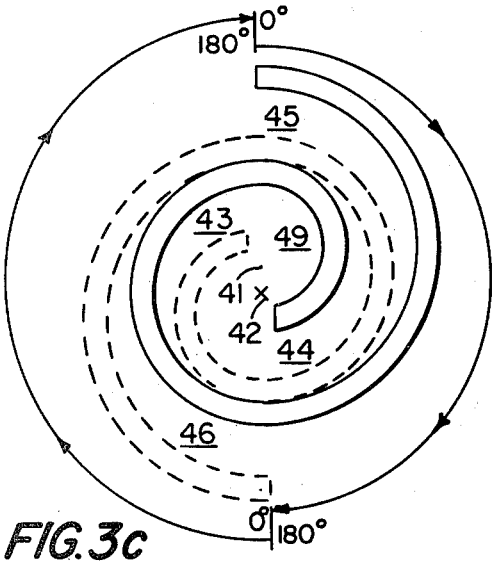
Figure 3D:
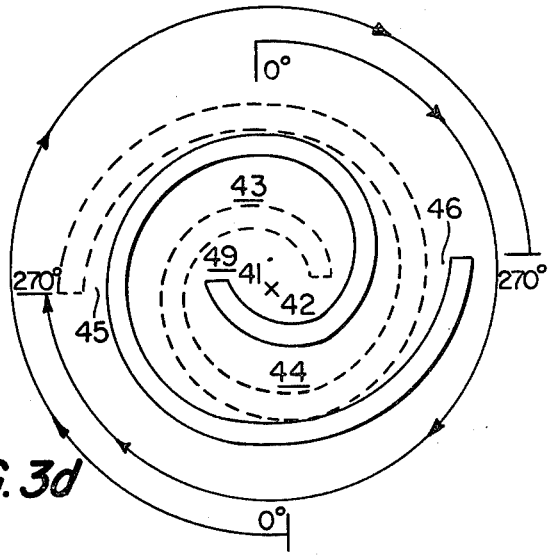
Figure 3E:
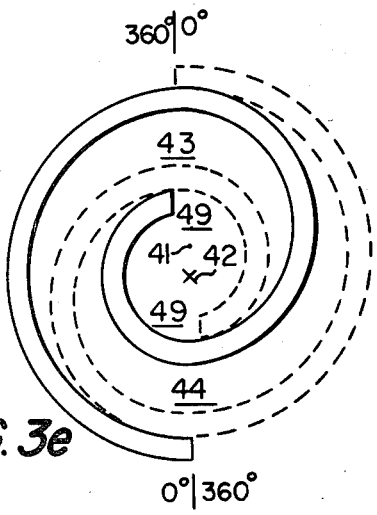
Figure 2:
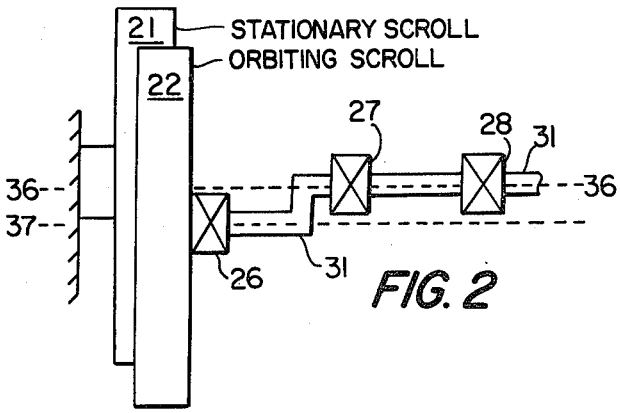
FIG. 2 is a simplified plan view of a prior art scroll pump illustrating how input power is applied to the scroll vanes to create a pumping action.

This invention produces a positive displacement pumping action in the manner shown in FIGS. 3*a* through 3*e*. Each of these five figures shows scroll vane 39 which is rotating about point 42 and scroll vane 40 which is rotating about point 41. The two scroll vanes are synchronously rotating clockwise. By synchronously rotating it is meant that any point on one vane is always separated in angular position from the equivalent point on the other vane by a constant angle. In the example illustrated in FIG. 3, this constant angle is always 180 degrees. If four scroll vanes were meshed with each other to form two scroll impellers, the angular separation between the vanes would be 90 degrees instead of 180 degrees. From the position of the two scroll vanes shown in FIG. 3*a*, the vanes in FIG. 3*b* have rotated 90 degress clockwise, the vanes in FIG. 3*c* have rotated 180 degrees clockwise, the vanes in FIG. 3*d* have rotated 270 degress clockwise, and the vanes in FIG. 3*e* have made one complete 360 degree rotation. As the two scroll vanes are synchronously rotated, the central space 49 splits into spaces 43 and 44 which move from the centers of the scroll vanes toward their outside circumference. As shown in FIG. 3*e*, after one complete rotation of the scrolls, spaces 43 and 44 have moved into positions equivalent to spaces 45 and 46, respectfully, in FIG. 3*a*. As shown in FIGS. 3*a* through 3*d*, when the scrolls continue to rotate, the spaces 45 and 46 will continue to move toward the outside of the scrolls. Thus it can be seen that any fluid which would be in spaces 49 in FIG. 3*a* would, after approximately one rotation of the scroll vanes, be moved to the outside of the vanes and expelled from them. This movement of fluid through the spaces between the vanes would result primarily from the changes in the size and position of the spaces between these vanes and not from any centrifugal force which these vanes might impart on the fluid. Therefore the pumping action illustrated in FIG. 3 is primarily a positive displacement pumping action. If the scroll vanes were to be rotated in a counterclockwise direction instead of a clockwise direction, fluid could be pumped from the outside circumference of the vanes toward the center. This fact can be verified by following the positions of the two scroll vanes in FIGS. 3*a* through 3*e* in the reverse order from the way in which the vane movements were discussed above. In general, fluid will be pumped from the center to the outside of the vanes when the vanes are rotated in the same direction as the direction of decreasing radius of the scroll vanes. Fluid will be pumped from the outside to the center of the vanes when they are rotated in the direction of increasing radius of the scroll vanes.

In FIG. 3, the centers 41 and 42 of the two vanes 40 and 39 remain in fixed positions. However, the synchrous rotation of the two vanes produces a pumping action similar to that produced by prior art scroll pumps and illustrated in FIG. 1. Since the pumping action of the prior art scroll pumps, as illustrated in FIG. 1, is a result of orbital motion of one of the scroll vanes, the movements of the two vanes in accordance with this invention may be referred to as relative orbiting motion. The distance between the centers of the two vanes 41 and 42 is equivalent to the orbiting radius of the orbiting scroll vane in the prior art scroll pumps.

The preferred embodiment of this invention is shown in FIGS. 4 through 11. When the same part or feature is shown in more than one of the figures, it is labeled with the same number. The preferred embodiment has two scroll impellers 59 and 60 which comprise vanes 76 and 74 mounted on back plates 51 and 52, respectfully. The driver impeller 59 is mounted on the input drive shaft 47 which is supported by two bearings 54 and 53. The driven impeller 60 is mounted on the stationary shaft 55 and is supported by the two bearings 56 and 57. The bearings 53 and 54 fit in and are supported by the casing 48 and the stationary shaft 55 fits into and is supported by the casing 50. The bolts 63 and nuts 62 hold the casings 48 and 50 and the spacer ring 58 in their proper positions relative to each other. After the stationary shaft 55 is aligned, it is held in its proper position by nuts 65 on the bolts 64 which are anchored in the casing 50. The central axis 82 about which the driven impeller 60 rotates is parallel to but offset from the central axis 80 about which the drive shaft 47 and driver impeller 59 rotates. The central axis 81 of the outside cylindrical surface 96 of the stationary shaft is offset from the central axis 82 about which the driven impeller 60 rotates. The oldham ring 66 between the two impellers transmits rotational force from the driver impeller 59 to the driven impeller 60 and also synchronizes the rotation of the two impellers by maintaining a constant angular relationship between them. This embodiment of the pump was designed to pump fluid in through port 68 in the stationary shaft, through intake port 70 in the center of the driven impeller 60, outward between the vanes 74 and 76 of the two impellers, through path 78 around the oldham ring 66, into the plenum 87 around the outside of the impellers and out of the pump through port 61. The seals 83 and 86 are in the shape of circular rings which are mounted concentric with the central axis 80 of the driver impeller. The graphite inserts 84 of the seals 83 and 86 are pressed against the back plates 51 and 52 of the two impellers by the force of the springs 85. The O-rings 89 prevent high pressure fluid from leaking out of the plenum 87 through the spaces between the seals and the casing. The total force of the fluid pressure in the plenum 87 holding the impeller back plates together will be greater than the total force of the fluid pressure between the back plates pushing them apart. Therefore, the two impellers will be held together by the fluid pressure within the plenum 87. For efficient pump operation it is important that there should be very little clearance between the scroll vane 76 and the back plate 52 and also very little clearance between the scroll vane 74 and the back plate 51. The positions of the seals 83 and 86 should be chosen so that the pressure applied to the back plate 51 and 52 of the impellers will be enough to hold them together and minimize the clearance betweem them.

At the same time, the pressure holding the two impellers together should be kept as small as is possible so as to minimize the wear which will result from the scroll vanes of one impeller rubbing against the back plate of the opposing impeller. This pump could be modified to pump fluid from the outside plenum 87 through to the center of the impellers and out port 68 by rotating the impellers in the opposite direction and inserting a different set of seals.

Figure 4:
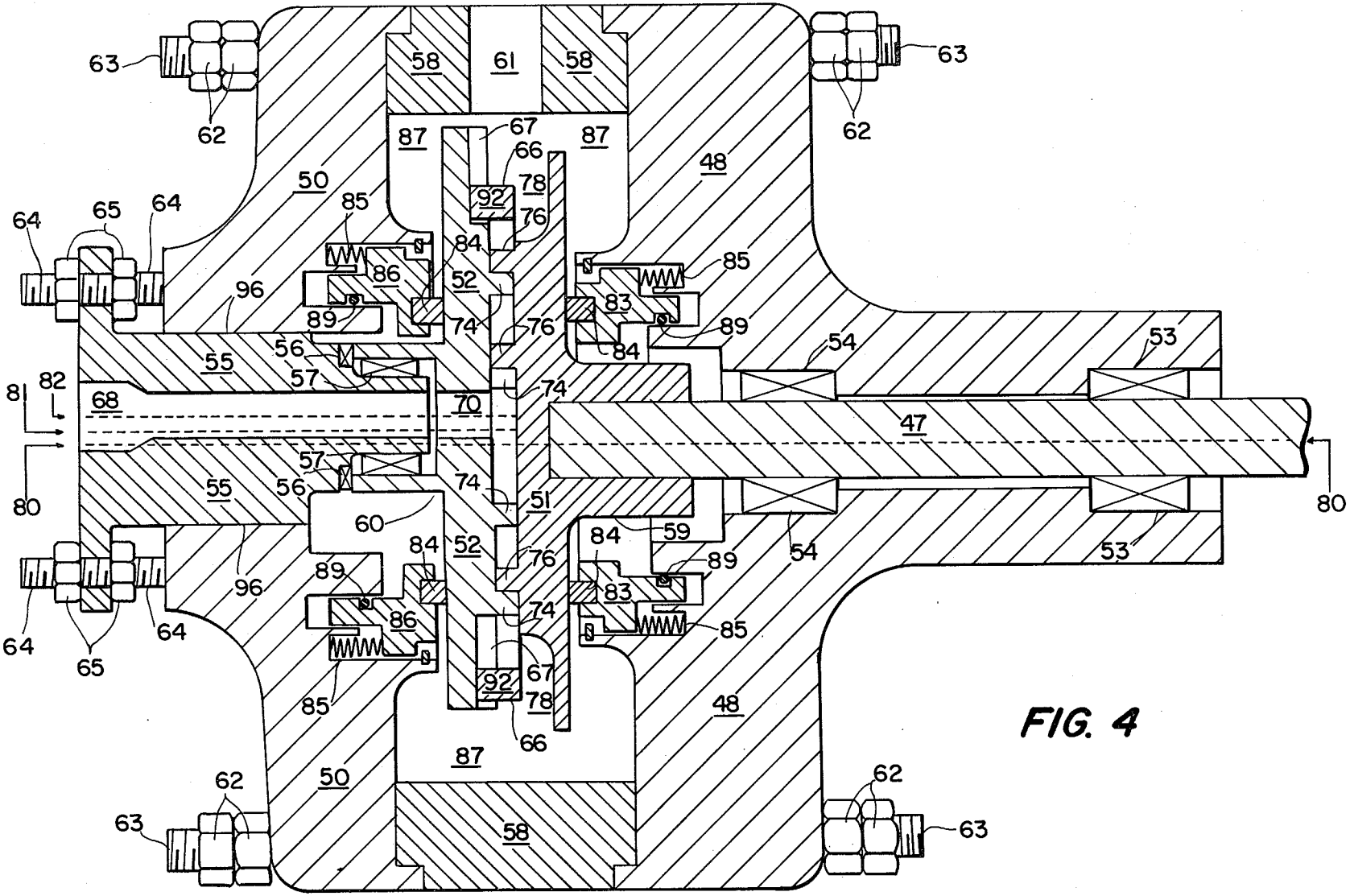
FIG. 4 shows a cross-sectional view of the complete assembly of the preferred embodiment of this invention.

FIGS. 5 and 6 show further details of the oldham ring 66 which is used to transmit torque between the driver impeller 59 and the driven impeller 60 and to hold the two impellers in synchronization of each other. The oldham ring 66 has four tabs 91 and 92 by which it engages the two impellers. The tabs 91 engage the driver impeller in slots on opposite sides of the outside circumference of the back plate 51. As shown in FIGS. 4 and 7, the tabs 92 on the oldham ring 66 engage the driven impeller 60 in slots 67 on the outside circumference of the back plate 52. When the two impellers are mounted in the pump and properly aligned, the two slots on the driven impeller 60 will be rotated 90 degrees away from the two slots on the driver impeller 59. The two sets of tabs 91 and 92 on the oldham ring are also rotated 90 degrees apart from each other so that the oldham ring will engage both of the impellers and hold them at the proper angular relationship in respect to each other as they are rotated. Rotational power is transmitted through the drive shaft 47, the driver impeller 59, and the oldham ring 66 to the driven impeller 60. Each time the impellers rotate, the tabs 91 and 92 on the oldham ring must slide back and forth in the slots on the two impellers to compensate for the fact that the impellers are not rotating on the same axis. The greater the distance between the two axes about which the impellers are rotating, the greater must be the length of the slots in which the tabs of the oldham ring slide.

FIGS. 8 and 9 show two cross-sectional views of the driven impeller 60 which is shown in a plan view in FIG. 7. The outer perimeter 93 of the back plate 52 is reduced in thickness so as to allow fluid pumped to the outside of the impeller to flow around the oldham ring.

Figure 10:
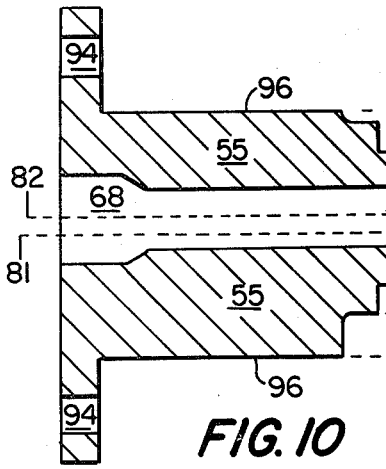
FIG. 10 shows a cross-sectional view of the stationary shaft 55 which supports the driven impeller of the preferred embodiment of the invention shown in FIG. 4.
Figure 11:
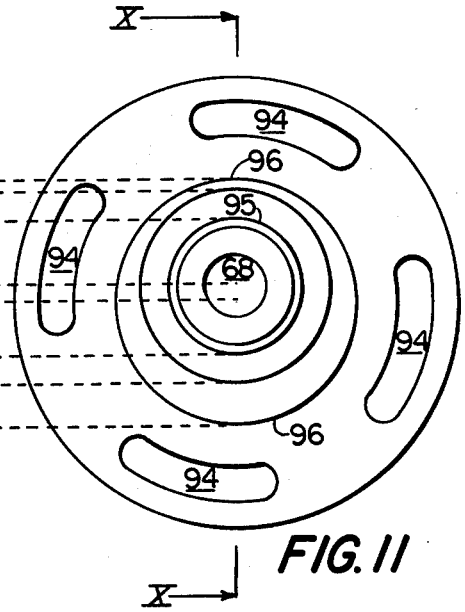
FIG. 11 shows a plan view of the stationary shaft shown in FIG. 10.

FIG. 11 shows a plan view of the stationary shaft 55 as it would be seen from the position of the drive shaft 47 in FIG. 4. FIG. 10 shows a cross-sectional view of the same stationary shaft with dashed lines drawn between equivalent points in FIGS. 10 and 11. The driven impeller 60 is mounted by means of bearing 57 on the cylindrical bearing race 95 of the stationary shaft. The central axis 82 of the bearing race 95 and the driven impeller 60 is offset from the central axis 81 of the outside cylindrical surface 96 of the stationary shaft. Therefore, as the stationary shaft 55 is rotated about its axis 81, the position of the axis 82 with respect to the rest of the pump will also rotate. Since the driven impeller 60 is mounted about the axis 82, the distance between the axis of the two impellers will also be changed. As is shown in FIG. 4, the stationary shaft 55 is positioned within the pump casing 50 so that the distance between the axis 81 of the stationary shaft and the axis 80 of the drive shaft 47 is approximately equal to the distance between the axis 81 of the stationary shaft and the axis 82 of the driven impeller 60. Therefore, the amount of offset between the driver impeller 59 on axis 80 and the driven impeller 60 on axis 82 may be adjusted continuously between the zero and the maximum separation which is illustrated in FIG. 4. This adjustment is facilitated by making the mounting holes 94 in the stationary shaft 55 in the form of slots. If an appropriate actuator were used to rotate the stationary shaft 55, the offset distance between the two impellers could be adjusted while the pump is in operation.

Figure 12:
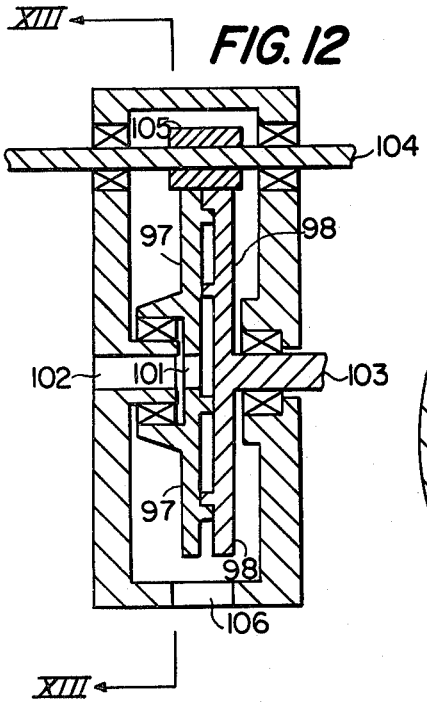
FIG. 12 shows a cross-sectional view of an alternative embodiment of this invention wherein both of the scroll impellers are driven directly from the input drive shaft.
Figure 13:
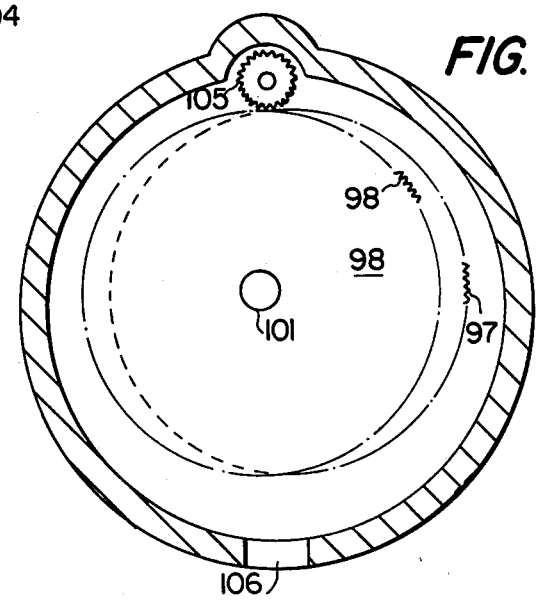
FIG. 13 shows another cross-sectional view of the alternative embodiment shown in FIG. 12.

In the preferred embodiment of the invention illustrated in FIGS. 4 through 11, all of the rotational power was applied directly to one scroll impeller and then some of the rotational power was transmitted through the oldham ring to the other scroll impeller. In the alternative embodiment shown in FIGS. 12 and 13, the pump could be operated in two different modes. The rotational power could be applied to shaft 103 to impeller 98 and then transmitted by way of gear 105 to the other impeller 97. Alternatively, the rotational power could be applied to shaft 104 and then transmitted directly by means of gear 105 to both of the impellers 97 and 98 at the same time. Once the two impellers 97 and 98 are properly positioned and their gear teeth around their outside circumference are meshed with the teeth of gear 105, the two impellers will always have the same angular relationship with one another and therefore will always be synchronized. Means could be provided in a pump of this type for adjusting the distance of the axes of the two impellers while the pump is in operation by moving the shaft 103 laterally. In this embodiment fluid will flow into and out of the pump through the ports 102, 101 and 106. Those skilled in the art could apply rotational power to the two scroll impellers and synchronize the two scroll impellers in many other ways. The embodiments of this invention which have been described could be used equally well to pump either liquids or gases.

The scroll vanes used in the preferred embodiment of this invention and illustrated in FIGS. 3 and 7 have a compression ratio of one when they are in operation. The pump neither attempts to compress nor to expand the fluid passing through it. This characteristic is desirable when pumping relatively uncompressable fluids such as water or oil since any power used to attempt compressing such fluids would be wasted power. If the vanes were made longer than is shown in the illustrations, they would have a compression ratio larger than one and they could be used to compress or expand gases. The new method of producing a positive displacement pumping action, by synchronously rotating the scroll vanes on parallel but offset axes, will work as well with compressors and expanders as it does with the pump which was illustrated.

Obviously, many other modifications and variations of this invention are possible in light of the above teachings. It is therefore to be understood that within the scope of the appended claims the invention may be practiced otherwise than as specifically described.

What is claimed is:

1. A positive displacement fluid pump comprising:

a casing;

a pair of facing scroll vane impellers in operative meshed relationship rotatably mounted within the casing on parallel offset axes;

one port through the casing terminating between the impellers near their axes of rotation and another port through the casing located radially of the impellers;

means for rotating one of the impellers;

ring means outwardly surrounding the scroll vanes and slidably engaging facing portions of each impeller for transmitting rotary motion from said one impeller to the other impeller while permitting relative orbital motion therebetween whereby fluid is caused to flow between the scroll vanes and through the ports; and means for adjusting the distance between the impeller axes for controlling pump output.

* * * * *